US007387272B2

(12) United States Patent
Okot

(10) Patent No.: US 7,387,272 B2
(45) Date of Patent: Jun. 17, 2008

(54) HIDDEN DRAWSTRING ASSEMBLY

(75) Inventor: Alex W Okot, Amsterdam (NL)

(73) Assignee: Nike, Inc., Beaverton, OR (US)

( * ) Notice: Subject to any disclaimer, the term of this patent is extended or adjusted under 35 U.S.C. 154(b) by 413 days.

(21) Appl. No.: 11/071,066

(22) Filed: Mar. 3, 2005

(65) Prior Publication Data

US 2006/0196022 A1 Sep. 7, 2006

(51) Int. Cl.
*B65H 75/30* (2006.01)

(52) U.S. Cl. ..... 242/395.1

(58) Field of Classification Search ..... 242/395, 242/395.1

See application file for complete search history.

(56) References Cited

U.S. PATENT DOCUMENTS 3,937,415 A * 2/1976 Prinz ..... 242/396.1
4,272,036 A * 6/1981 Watermann ..... 242/394
4,719,709 A * 1/1988 Vaccari ..... 36/117.8
4,719,710 A 1/1988 Pozzobon et al.
5,388,877 A * 2/1995 Wenk ..... 294/1.1
5,934,599 A 8/1999 Hammerslag et al.
6,928,703 B2 8/2005 Petravic et al.
2003/0204970 A1 11/2003 Liu

FOREIGN PATENT DOCUMENTS

JP 2005-344228 12/2005

* cited by examiner

*Primary Examiner*—William A Rivera
(74) *Attorney, Agent, or Firm*—Banner & Witcoff, Ltd.

(57) ABSTRACT

A hidden drawstring apparatus includes a housing and a rotatable hub positioned within the housing. The hub is configured to receive an end of a drawstring to be wound about the hub. A handle assembly is rotatably connected to the housing. A drive member has a first end connected to the handle assembly and a second end connected to the rotatable hub.

21 Claims, 4 Drawing Sheets

HIDDEN DRAWSTRING ASSEMBLY

FIELD OF THE INVENTION

This invention relates generally to drawstrings for use in apparel and other objects, and, in particular, to a hidden drawstring assembly for use in apparel and other objects.

BACKGROUND OF THE INVENTION

Drawstrings are well known for closing or tightening items such as articles of apparel and duffle bags. When drawstrings are used on a hood of a coat or jacket, for example, the hanging drawstring can be cumbersome and an annoyance, and may create a safety issue due to the drawstring getting caught in or on another object. This can be especially dangerous for children.

It is an object of the present invention to provide a hidden drawstring assembly that reduces or overcomes some or all of the difficulties inherent in prior known devices. Particular objects and advantages of the invention will be apparent to those skilled in the art, that is, those who are knowledgeable or experienced in this field of technology, in view of the following disclosure of the invention and detailed description of certain preferred embodiments.

SUMMARY

The principles of the invention may be used to advantage to provide a hidden drawstring assembly that can be used to tighten a drawstring, and which allows the drawstring to be hidden, thereby preventing free ends of the drawstring from being exposed and minimizing the danger associated with free or loose drawstring ends.

In accordance with a first preferred embodiment, a hidden drawstring apparatus includes a housing and a rotatable hub positioned within the housing. The hub is configured to receive an end of a drawstring to be wound about the hub. A handle assembly is rotatably connected to the housing. A drive member has a first end connected to the handle assembly and a second end connected to the rotatable hub.

In accordance with another preferred embodiment, a hidden drawstring apparatus includes a housing having a first aperture and a second aperture. A rotatable hub is positioned within the housing. A drawstring extends through the first aperture in the housing and has a first end secured to the hub. The drawstring is wound about and unwound from the hub as the hub rotates. A handle assembly is rotatably secured to an exterior of the housing. A drive member extends through the second aperture in the housing and is connected at a first end thereof to the handle assembly and at a second end thereof to the hub. The drive member transmits a rotational force applied to the handle assembly to the hub.

In accordance with a further embodiment, a hidden drawstring apparatus includes a housing having a first portion, a second portion releasably secured to the first portion, a first aperture, and a second aperture. A rotatable hub is positioned within the housing. A drawstring extends through the first aperture in the housing and has a first end secured to the hub. The drawstring is wound about and unwound from the hub as the hub rotates. A handle assembly is rotatably connected to the housing and includes a handle housing, a base portion secured to the handle housing, an arm pivotally secured to the base portion, and a drive member. The drive member has a first end connected to the arm and a second end connected to the rotatable hub, and extends through the second aperture in the housing. The drive member has a first end connected to the handle and a second end connected to the hub. The drive member is configured to transmit a rotational force applied to the handle to the rotatable hub.

Substantial advantage is achieved by providing a hidden drawstring assembly. In particular, certain preferred embodiments of the present invention provide an apparatus that allows a drawstring to be tightened, while keeping a free end of the drawstring concealed. This is highly advantageous since it prevents the free end from being exposed, minimizing the danger of the drawstring getting caught or snagged on or in another object. This is especially advantageous for use on children's apparel.

These and additional features and advantages of the invention disclosed here will be further understood from the following detailed disclosure of certain preferred embodiments.

Figure 1:
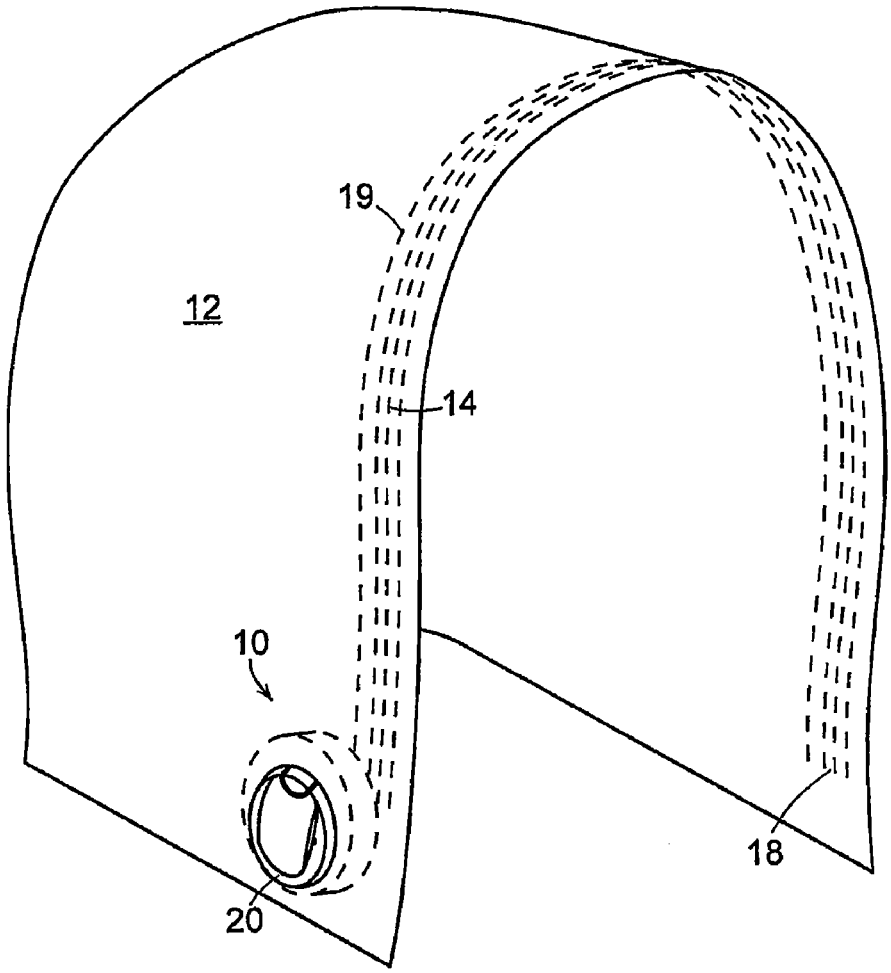
FIG. 1 is a perspective view of a hidden drawstring assembly in accordance with a preferred embodiment of the present invention, shown in use on a hood of an article of apparel.

The figures referred to above are not drawn necessarily to scale and should be understood to provide a representation of the invention, illustrative of the principles involved. Some features of the hidden drawstring assembly depicted in the drawings have been enlarged or distorted relative to others to facilitate explanation and understanding. The same reference numbers are used in the drawings for similar or identical components and features shown in various alternative embodiments. Hidden drawstring assemblies as disclosed herein would have configurations and components determined, in part, by the intended application and environment in which they are used.

DETAILED DESCRIPTION OF CERTAIN PREFERRED EMBODIMENTS

The present invention may be embodied in various forms. A preferred embodiment of a hidden drawstring assembly 10 is shown in FIG. 1. Hidden drawstring assembly 10 is shown here in use on a hood 12 of an article of apparel. As used herein, the term apparel includes footwear. It is to be appreciated that the hidden drawstring assembly of the present invention is not intended to be limited to use in apparel and can be used in any suitable device. For example, a hidden drawstring assembly 10 may be used in a bag, such as a duffel bag or backpack. Other suitable applications will become readily apparent to those skilled in the art, given the benefit of this disclosure.

A drawstring 14 extends about a periphery of hood 12, with a first end 16 (not visible here) of drawstring 14 secured to drawstring assembly 10 and a second end 18 of drawstring 14 secured to hood 12 by stitching or other suitable means. Drawstring 14 is concealed within hood 12. In the illustrated embodiment, drawstring 14 is located in a sleeve 19 formed in hood 12. Sleeve 19 may be formed by folding over and securing an edge of hood 12 by stitching or other suitable means. In another embodiment, sleeve 19 may be formed by a pair of opposed lines of stitching extending along the edge of hood 12. In yet other embodiments, a strip of material may be secured to hood 12 by stitching or other suitable means to form sleeve 19.

To tighten drawstring 14 about hood 12, the user turns an arm of a handle assembly 20 on drawstring assembly 10 to wind drawstring 14 within drawstring assembly 10 as described in greater detail below. Drawstring 14 is advantageously hidden within hood 12 and drawstring assembly 10 such that its ends do not hang free both when drawstring is tightened and when it is in its loose configuration, thereby minimizing any risk of the drawstring getting caught on another object.

It is to be appreciated that in certain preferred embodiments, an additional drawstring assembly 10 can be provided on the other side of hood 12, with second end 18 of drawstring 14 wound within the additional drawstring assembly 10 rather than being secured directly to hood 12.

Figure 2:
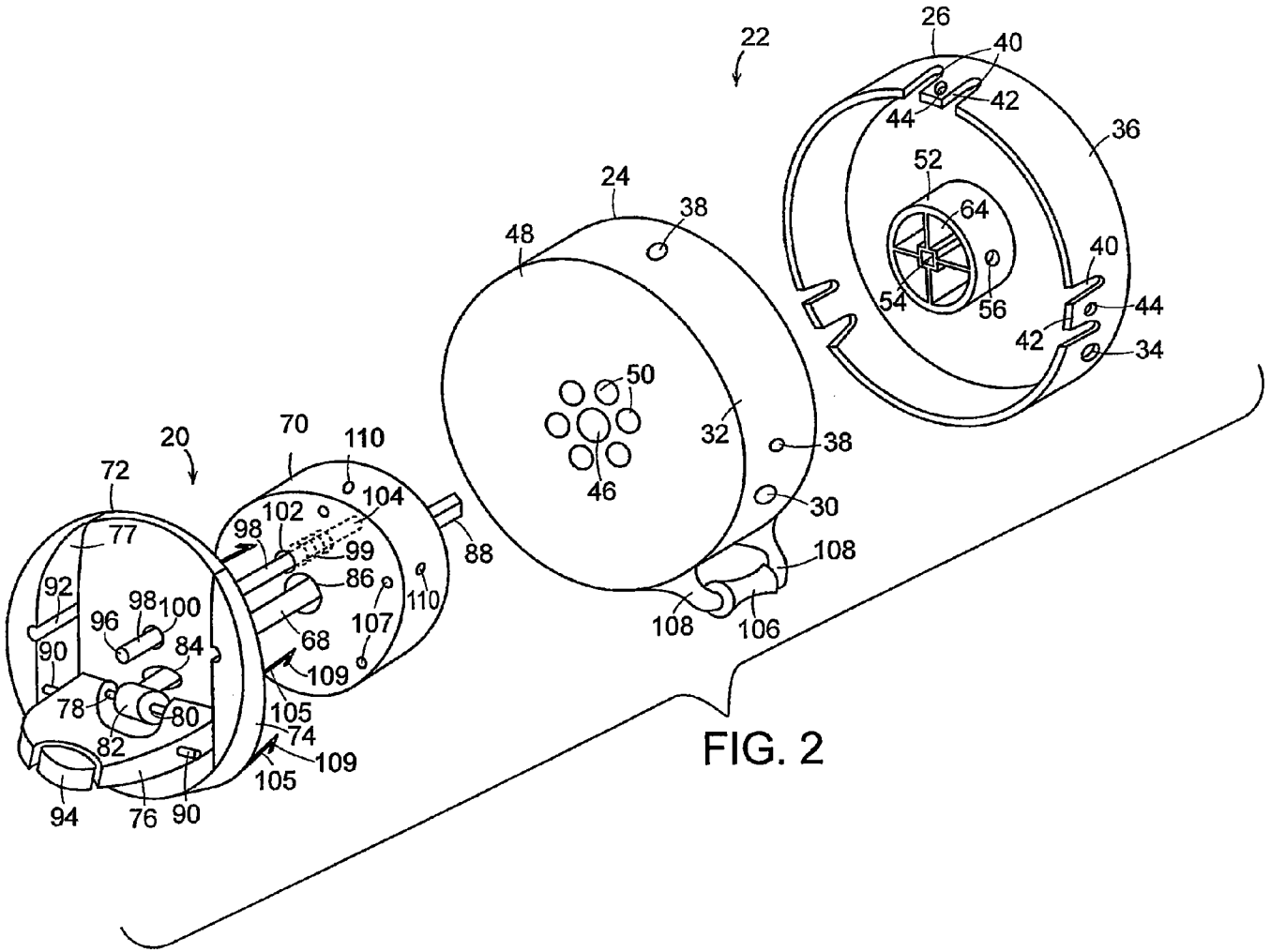
FIG. 2 is an exploded view of the drawstring assembly of FIG. 1.

Drawstring assembly 10 is seen in greater detail in FIG. 2 in exploded fashion. Drawstring assembly 10 includes a housing 22 formed of a first portion 24 and a second portion 26. A first aperture 28 in housing 22 (seen in FIGS. 1 and 4) is formed by an aperture 30 in a radially outward wall 32 of first portion 24 and a mating aperture 34 in a radially outward wall 36 of second portion 26. Second portion 26 is nested within first portion 24 such that aperture 30 and aperture 34 align to define first aperture 28.

A plurality of apertures 38 are formed in wall 32 of first portion 24. A plurality of pairs of slots 40 are formed in wall 36 of second portion 26. Each pair of slots 40 extends axially inwardly from an axially exterior edge of wall 36 to define a flexible arm 42. A projection 44 is formed on a radially outward surface of each flexible arm 42. Each projection 44 is received in a corresponding aperture 38 when second portion 26 is nested within first portion 24. Flexible arms 42 move radially, allowing projections 44 to be released from engagement with apertures 38. To separate first portion 24 and second portion 26 from one another, a user simply presses projections 44 radially inwardly with their finger or a pin, rod or other suitable member, thereby releasing projections 44 from engagement with apertures 38, allowing first portion 24 and second portion 26 to be pulled apart from one another. A second aperture 46 is formed in a central portion of an axially outward wall 48 of first portion 24. A plurality of locking apertures 50 is disposed about second aperture 46.

Figure 3:
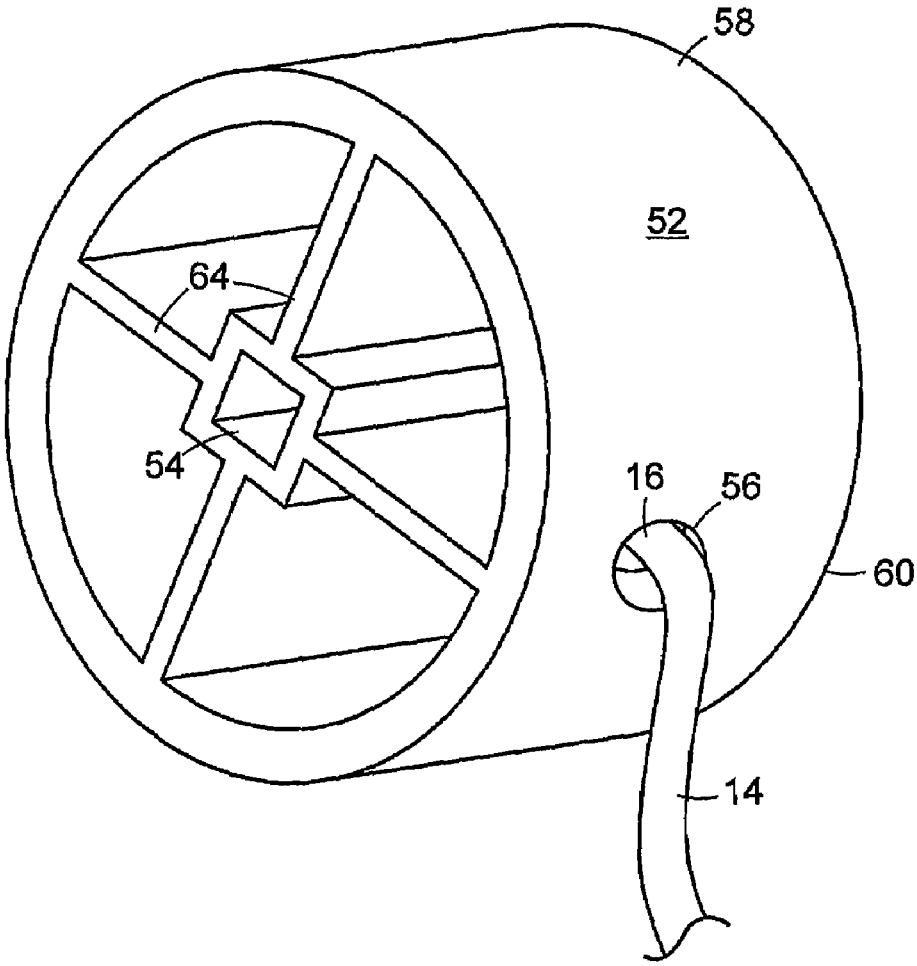
FIG. 3 is a perspective view of the hub of the drawstring assembly of FIG. 1.

A hub 52 is positioned within second portion 26 and includes a drive pin seat 54. As seen more clearly in FIG. 3, a drawstring aperture 56 is formed in a radially outward wall 58 of hub 52. Drawstring aperture 56 receives first end 16 of drawstring 14. First end 16 may be anchored to hub 52 by a knot tied in its end (not shown) or any other suitable fastening means. Drawstring 14 is wound about hub 52 as drawstring 14 is tightened about hood 12, as described in greater detail below. As illustrated here, a cylindrical wall 58 of hub 52 extends from a base 60. Interior walls 64 extend radially inwardly from wall 58 to drive pin seat 54. Drive pin seat 54 receives a drive pin 68 of handle assembly 20 as described in greater detail below. As illustrated here, drive pin seat 54 is substantially rectangular in shape. It is to be appreciated that drive pin seat 54 may have any shape that mates with and receives drive pin 68.

It is to be appreciated that in other embodiments, slots 40, flexible arms 42 and projections 44 can be positioned on first portion 24 with apertures 38 formed in second portion 26. In the illustrated embodiment, housing 22 and, therefore, first portion 24 and second portion 26, are substantially cylindrical. However, it is to be appreciated that other shapes of housing 22 are considered to be within the scope of the present invention.

Handle assembly 20, seen in FIG. 2, includes a handle housing 70 and a handle portion 72. Handle portion 72 includes a base portion 74 and an arm 76 pivotally secured to base portion 74. Base portion 74 includes a recess 77 into which arm 76 may be folded. Thus, when handle assembly 20 is not being used to wind drawstring 14, arm 76 is folded into a compact configuration within base portion 74.

Arm 76 may be pivotally secured to base portion 74 by way of a pin 78 extending through an aperture 80 in a first end 82 of drive pin 68. Drive pin 68 extends through an aperture 84 in base portion 74 and through an aperture 86 in handle housing 70. A second end 88 of drive pin 68 extends through second aperture 46 in first portion 24 of housing 22 and is received in drive pin seat 54 of hub 52.

A pair of pins 90 extends outwardly from arm 76. Pins 90 are received in notches 92 formed in walls of recess 77. In a preferred embodiment, pins 90 are spring-loaded such that they are biased outwardly into engagement with notches 92 when arm 76 is folded into recess 77. Thus, in a non-operating condition, arm 76 is locked in place with respect to base portion 74. A release button 94 in arm 76 is connected to spring-loaded pins 90 such that depressing release button relieves the biasing action on pins 90 and allows arm 76 to be pivoted outwardly from base portion 74. It is to be appreciated that in certain preferred embodiments a single pin 90 can be provided on arm 76.

A first end 96 of a spring-loaded locking pin 98 extends through an aperture 100 in base portion 74. Locking pin 98 extends through an aperture 102 in handle housing 70, with a second end 104 of locking pin 98 extending through any one of locking apertures 50 in first portion 24 of housing 22 into hub 54. Second end 104 abuts against interior walls 64 of hub 54 to prevent rotation of hub 54 and unwinding of drawstring 14 when handle assembly 20 is in a locked condition. The spring 99 biasing pin 98 outwardly is contained within handle housing 70. When arm 76 is folded inwardly into recess 77 of base portion 74, arm 76 engages first end 96 of locking pin 98, forcing it inwardly such that second end 104 is received in a locking aperture 50 with which it is aligned. The engagement of locking pin 98 within a locking aperture 50 fixes handle assembly 20 with respect to housing 20. When arm 76 is folded outwardly from base portion 74 into its operating position, locking pin 98 springs outwardly out of engagement with the locking aperture 50. In this condition, handle assembly 20 can be rotated, allowing drawstring 14 to be wound about hub 52. After arm 76 has been rotated a sufficient amount to place drawstring 14 in a desired tightened position, arm 76 is folded back into recess 76, thereby depressing locking pin 98 such that its second end 104 engages a corresponding locking aperture 50.

Figure 4:
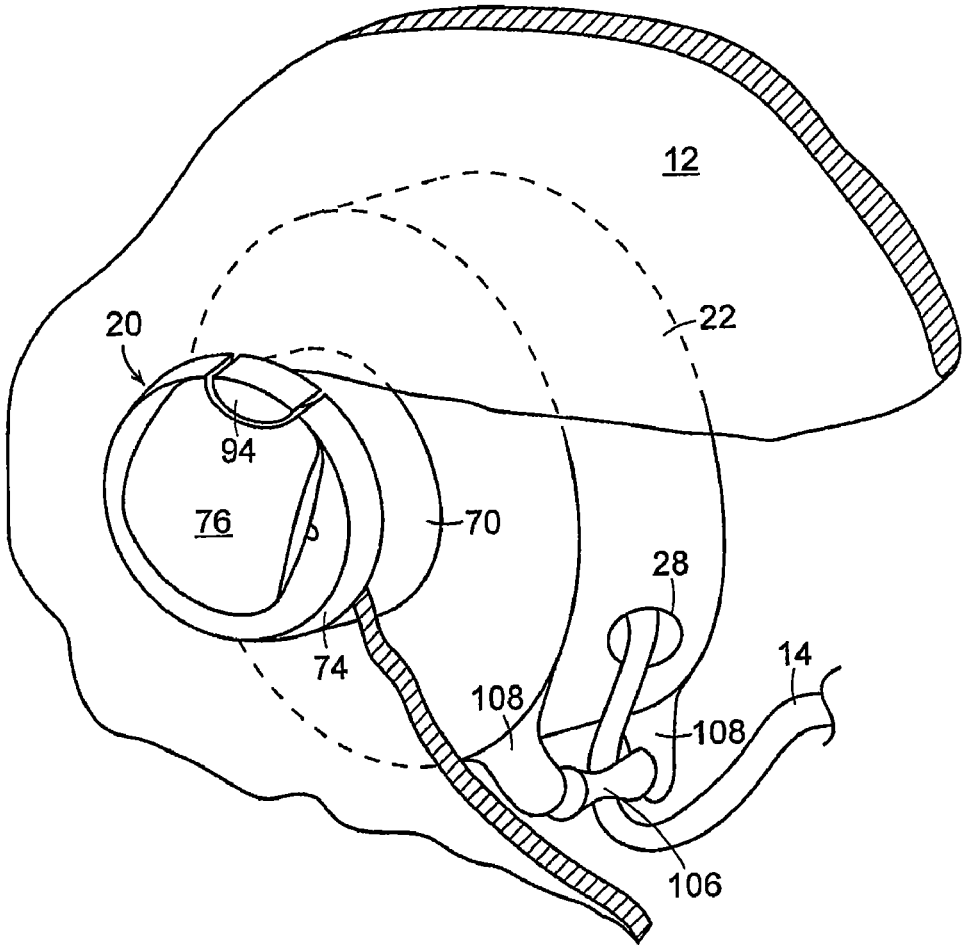
FIG. 4 a perspective view, shown partially broken away, of a portion of the drawstring assembly of FIG. 1, shown installed in the hood of FIG. 1.

A plurality of pins 105 extend outwardly from base portion 74 and are received in corresponding recesses 107 formed in handle housing 70, thereby securing base portion 74 to handle housing 70. Pins 105 may include barbs 109 on ends thereof, which are received in recesses 110 formed in the wall of handle housing 70. A pin, rod or other suitable member may be inserted into recesses 110 to release barbs 109 and pins 105, allowing base portion 74 to be separated from handle housing 70. As seen in FIG. 4, a portion of the fabric of hood 12 (or the material of any other object to which hidden drawstring assembly 10 is attached) is captured between base portion 74 and handle housing 70, thereby securing hidden drawstring assembly 10 to hood 12.

As seen in FIG. 4, a guide member such as a roller bar 106 is supported by a pair of flanges 108 extending outwardly from first portion 24 of housing 22. Drawstring 14 exits aperture 28 in housing 22 and wraps around roller bar 106, reducing the chance of drawstring 14 getting hung up on the edge of aperture 28.

In light of the foregoing disclosure of the invention and description of the preferred embodiments, those skilled in this area of technology will readily understand that various modifications and adaptations can be made without departing from the scope and spirit of the invention. All such modifications and adaptations are intended to be covered by the following claims.

What is claimed is:

1. A hidden drawstring apparatus comprising, in combination:

an article of apparel;

a drawstring having a first end and a second end, the second end being secured to a portion of the article of apparel, the drawstring being concealed within the article of apparel;

a housing secured to the article of apparel and having a first aperture configured to receive the drawstring, a second aperture through which the drive member extends, and a plurality of locking apertures disposed about the second aperture;

a rotatable hub positioned within the housing, the first end of the drawstring being wound about the hub;

a handle assembly rotatably connected to the housing and having a locking pin extending axially inwardly from an interior surface of the handle, the locking pin being receivable in the locking apertures and biased axially outwardly; and a drive member has a first end connected to the handle assembly and a second end connected to the rotatable hub.

2. The hidden drawstring apparatus of claim 1, wherein the handle assembly comprises a base portion and an arm pivotally secured to the base portion.

3. The hidden drawstring apparatus of claim 2, wherein the arm includes at least one pin and the base portion includes at least one notch, each notch receiving a corresponding pin when the arm is pivoted into an abutting relationship with the base portion.

4. The hidden drawstring apparatus of claim 3, wherein each pin is biased outwardly from the arm and the arm includes a release button connected to each pin and configured to release the pin from an outwardly biased condition.

5. The hidden drawstring apparatus of claim 2, wherein the base portion includes a recess into which the arm can be pivoted.

6. The hidden drawstring apparatus of claim 1, wherein the handle assembly further comprises a handle housing to which the base portion is connected.

7. The hidden drawstring apparatus of claim 6, wherein the base portion includes a plurality of pins and the handle housing includes a plurality of recesses, each recess receiving a corresponding pin to secure the base portion to the handle housing.

8. The hidden drawstring apparatus of claim 1, wherein the housing comprises a first portion and a second portion releasably secured to the first portion.

9. The hidden drawstring apparatus of claim 8, wherein one of the first portion and the second portion includes a plurality of projections and the other of the first portion and the second portion includes a plurality of apertures, each projection releasably received in a corresponding recess to releasably secure the first portion to the second portion.

10. The hidden drawstring apparatus of claim 9, wherein the one of the first portion and the second portion including a plurality of pairs of slots extending radially inwardly from an exterior surface thereof, each pair of slots defining a flexible arm, wherein each projection is positioned on a corresponding flexible arm.

11. The hidden drawstring apparatus of claim 1, further comprising a guide member secured to an exterior of the housing proximate the first aperture.

12. The hidden drawstring apparatus of claim 11, wherein the guide member comprises a roller bar extending between a pair of flanges extending outwardly from an exterior of the housing.

13. The hidden drawstring apparatus of claim 1, further comprising a spring in the handle biasing the locking pin outwardly.

14. The hidden drawstring apparatus of claim 1, further comprising an article of apparel to which the housing and handle assembly are secured.

15. A hidden drawstring apparatus comprising, in combination:

an article of apparel;

a drawstring having a first end and a second end, the second end being secured to a portion of the article of apparel, the drawstring being concealed within the article of apparel;

a housing secured to the article of apparel and having a first aperture and a second aperture and a plurality of locking apertures disposed about the second aperture;

a rotatable hub positioned within the housing;

a drawstring extending through the first aperture in the housing and having a first end secured to the hub and a second end secured to a portion of the article of apparel, the drawstring being wound about and unwound from the hub as the hub rotates;

a handle assembly rotatably secured to an exterior of the housing and having a locking pin extending axially inwardly from an interior surface of the handle, the locking pin being receivable in the locking apertures and biased axially outwardly; and a drive member extending through the second aperture in the housing and connected at a first end thereof to the handle assembly and at a second end thereof to the hub, the drive member transmitting a rotational force applied to the handle assembly to the hub.

16. The hidden drawstring apparatus of claim 15, wherein the handle assembly comprises a base portion and an arm pivotally secured to the base portion.

17. The hidden drawstring apparatus of claim 15, wherein the handle assembly further comprises a handle housing to which the base portion is connected.

18. The hidden drawstring apparatus of claim 15, wherein the housing comprises a first portion and a second portion releasably secured to the first portion.

19. The hidden drawstring apparatus of claim 15, wherein the housing includes a plurality of locking apertures disposed about the second aperture.

20. The hidden drawstring apparatus of claim 19, further comprising a locking pin extending axially inwardly from an interior surface of the handle, the locking pin receivable in the locking apertures.

21. A hidden drawstring apparatus comprising, in combination:

an article of apparel;

a housing secured to the article of apparel and having a first portion, a second portion releasably secured to the first portion, a first aperture, and a second aperture, and a plurality of locking apertures disposed about the second aperture;

a rotatable hub positioned within the housing;

a drawstring extending through the first aperture in the housing and having a first end secured to the hub and a second end secured to a portion of the article of apparel, the drawstring being wound about and unwound from the hub as the hub rotates and being concealed within the article of apparel;

a handle assembly rotatably connected to the housing and comprising:

a handle housing;

a base portion secured to the handle housing;

a locking pin extending axially inwardly from an interior surface of the handle, the locking pin being receivable in the locking apertures and biased axially outwardly;

an arm pivotally secured to the base portion; and a drive member having a first end connected to the arm and a second end connected to the rotatable hub;

wherein the drive member extends through the second aperture in the housing and is configured to transmit a rotational force applied to the handle to the rotatable hub.

* * * * *